US005359799A

United States Patent [19]

Moon

[11] Patent Number: 5,359,799

[45] Date of Patent: Nov. 1, 1994

[54] FIREARM TRIGGER BAR ATTACHMENT

[76] Inventor: Kook-Jin Moon, 630 Rte. 303, Blauvelt, N.Y. 10913

[21] Appl. No.: 81,226

[22] Filed: Jun. 25, 1993

[51] Int. Cl.[5] ..... F41A 19/10

[52] U.S. Cl. ..... 42/69.02; 89/136

[58] Field of Search ..... 42/69.02, 69.01, 70.08, 42/70.06; 89/136, 149, 27.14, 147, 154

[56] References Cited

U.S. PATENT DOCUMENTS

| | | | |
|---|---|---|---|
| 2,138,213 | 11/1938 | Seidel | 89/147 |
| 3,152,418 | 10/1964 | Charron | 42/69.03 |
| 3,889,412 | 6/1975 | Filecci | 99/147 |
| 4,005,540 | 2/1977 | Robinson | 42/69.02 |
| 4,067,131 | 1/1978 | Ruger | 42/65 |
| 4,109,402 | 8/1978 | Guardamino | 42/65 |
| 4,152,856 | 5/1979 | Tollinger et al. | 42/69.01 |
| 4,291,481 | 9/1981 | Hillberg | 42/70.02 |
| 4,575,963 | 3/1986 | Ruger et al. | 42/70.08 |

FOREIGN PATENT DOCUMENTS

| | | | |
|---|---|---|---|
| 227569 | 5/1963 | Australia | 42/69.01 |
| 1273372 | 7/1968 | Germany | 42/69.01 |

*Primary Examiner*—Stephen M. Johnson
*Attorney, Agent, or Firm*—Stanley J. Yavner

[57] ABSTRACT

A trigger to trigger bar attachment for firearms which includes a single side lug only of the trigger for attachment to the trigger bar, and a shouldered washer and spring, for which the shouldered washer is a spacer and boss.

3 Claims, 3 Drawing Sheets

FIREARM TRIGGER BAR ATTACHMENT

FIELD OF THE INVENTION

This invention relates to firearms and more particular to a compact firearm trigger and trigger bar design wherein the compactness is provided by a novel design of the means for attaching the trigger to the trigger bar.

BACKGROUND OF THE INVENTION

It should be understood that in addition to categorizing handguns into broad categories of single shot revolver, and automatic, subcategories of semi-automatic (autoloading) pistols and automatic firing pistols should also be considered. In order to indicate a typical handgun in which the present invention is useful, it is well to explain the workings of a semi-automatic, hand-held pistol with a breech-locking mechanism. A magazine stacked with cartridges is inserted into the gun. The magazine feeds the cartridges by using, for instance, spring pressure to push the stack of cartridges upwardly in the column, each time a cartridge is used by the gun. To load the cartridge into the chamber, a slide is pulled back with one hand, while holding the handle of the gun with the other hand. When the slide is pulled back, the barrel of the gun moves on a camway, serving to rotate the barrel slightly to thereby release the barrel from a lock, which in turn, serves to interlock the slide of the gun to the breech end of the barrel. Thus, the slide is moved back independently and then released to go forward under the bias of a recoil spring. A tongue depending from the slide catches the back of the first cartridge in the magazine and pushes it forward into the chamber. Thereafter, when the trigger is pulled, a mechanism is caused to make a firing pin strike the primer portion of a loaded cartridge. The function of the primer is to ignite the powder which is stored inside the cartridge, thereby expanding the gases in the cartridge to push the bullet (nose of the cartridge) out through the barrel. According to the laws of physics, an equal and opposite force pushes the slide rearward so that an extractor can pull the empty cartridge out of the chamber and an ejector causes the empty cartridge to be propelled out the side of the gun. The return stroke of the slide (caused by the bias of the recoil spring) enables the depending tongue to catch the back of the next cartridge in the magazine, in order to make it ready for firing. This repetitive cycle is repeated each time the trigger is pulled.

Although the invention concerns improvements intended primarily for use in connection with small firearms of the semi-automatic type, certainly, the invention described herein has utility in other types of firearms, as well. Therefore, all aspects of the present invention should not only be considered as extending to the type of firearm illustrated, but also to other types of firearms in which or for which the invention also extends.

In any event, with respect to all categories, the primary use of all handguns is fast becoming the target shooting area, wherein for sporting purposes or proficiency improvement purposes, the shooter improves by consistently using the handgun in order to come closer and closer to hitting a small target, at varying distances, each and every time he or she shoots. In doing this, it becomes very important to take into consideration the weight of trigger pull which suits the shooter and increases the shooter's proficiency with respect to hitting the target. Also, the comfort with which the shooter holds the handgun is in some respects effected by the compactness of the handgun.

One area in which compactness of the handgun can be effected and the weight of trigger pull can be adjusted relates to the means by which the trigger is attached to the trigger bar, and the designs of such elements.

Various handgun designs have been shown in the patent literature. For instance, the designs shown by Rugget, U.S. Pat. No. 4,067,131; Guardamino, U.S. Pat. No. 4,109,402; Charron, U.S. Pat. No. 3,152,418 and Filecci, U.S. Pat. No. 3,889,412 teach various improvements in handgun designs, but none which indicates or teaches the improvements in compactness and adjustability of the weight of trigger pull provided by the present invention by means of a novel design for attaching a trigger to the trigger bar.

OBJECTS OF THE INVENTION AND SUMMARY OF THE INVENTION

Accordingly, a primary object of the present invention is to provide a mechanism for attaching, in a handgun, the trigger to the trigger bar.

A further and more particular object of the present invention is to provide a means for securing the trigger bar to the trigger without any fastener in order to make the handgun mechanism simpler and more compact.

A still further object of the present invention is to avoid sandwiching such attachment between a pair of lugs of the trigger, thus making the mechanism more reliable and compact, in terms of reducing the distance between the barrel and the trigger.

Another object of the present invention is to provide an attachment for the trigger to the trigger bar in a handgun which enables providing an improved and more accurate firearm, which is safer to handle, which is sturdy and reliable, and yet provides ease of manufacture, simplicity and the satisfaction of the various objectives mentioned above, and others.

These and other objects of the invention are provided in a handgun which features a trigger to trigger bar attachment in the form of a shouldered washer installed on the shaft about which the trigger pivots. The trigger bar is attached to a single side lug of the trigger, rather than being sandwiched between a pair of lugs as in some other handguns. The trigger bar is so attached by a round stud which is an integral part of the trigger bar. The stud fits through a hole defined by the single side lug of the trigger, thereby allowing the trigger bar to swivel about the stud hole as a center. The shouldered washer is close fitting in order to prevent the trigger bar from working its way out of the stud hole, and the shouldered washer is installed onto the trigger pivot shaft after the trigger bar is in place. Also, the shouldered washer has a cut on one side, or other structural design, in order to fit within the confines of the trigger body. A tension spring is used with the shouldered washer serving as its boss and spacer in order to keep the spring positioned and aligned. Thereby, the weight of the trigger pull is adjusted by varying the thickness of the spring wire and by varying the shouldered washer dimensions to suit the desired weight change.

BRIEF DESCRIPTION OF THE DRAWINGS

These and other objects, features and advantages of the present invention are explained in the following detailed description of a preferred, but nonetheless illustrative, embodiment, with reference to the accompanying drawings, wherein.

DETAILED DESCRIPTION OF THE PREFERRED EMBODIMENT

Figure 1:
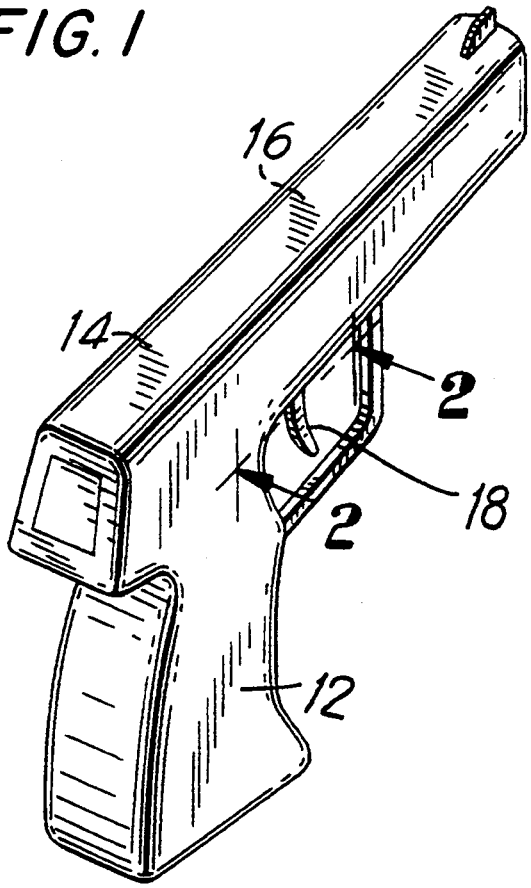
FIG. 1 is a back, top and right side isometric view of a handgun for which the present invention is useful.
Figure 3:
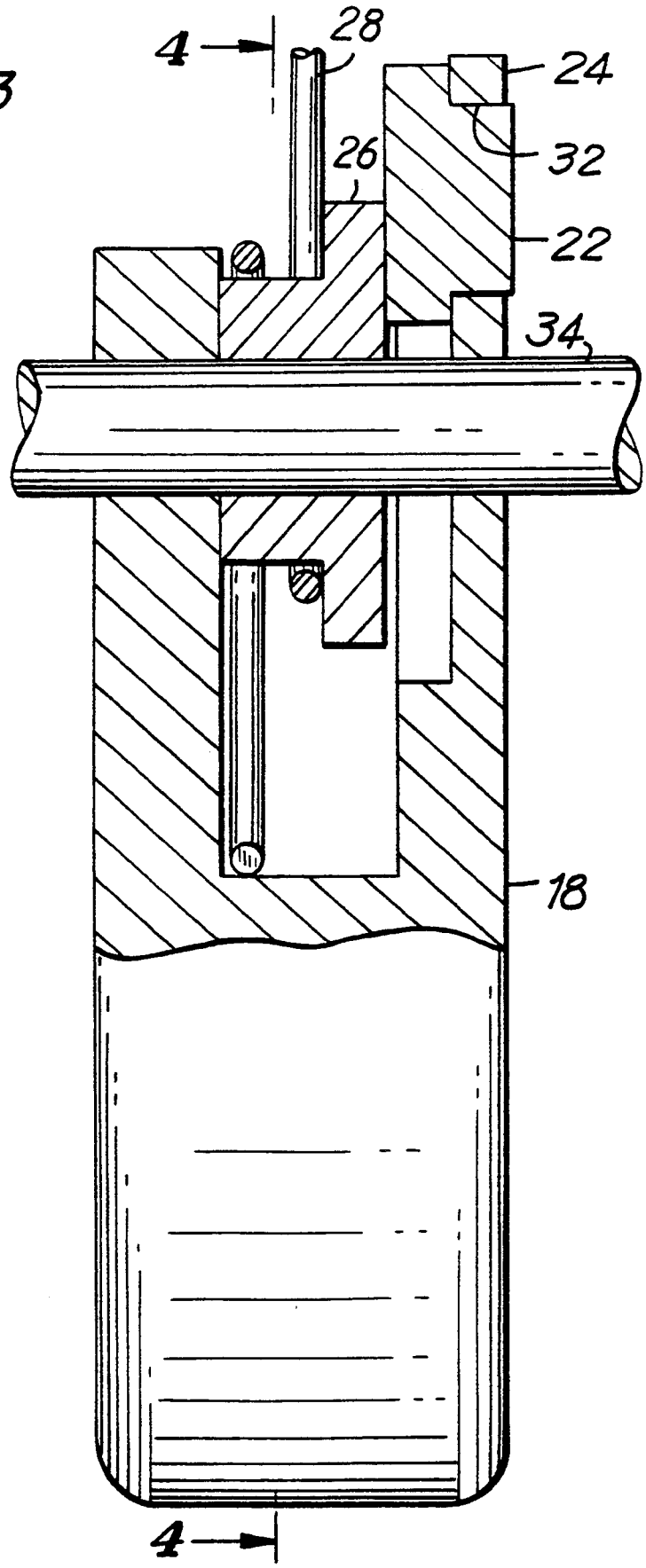
FIG. 3 is a rear, sectional view taken along the line 3—3 of FIG. 2 and showing the trigger pivot shaft, the shouldered washer encircling the pivot shaft, and the shouldered washer being encircled by the trigger tension spring; also shown is the relationship between the trigger bar and a single trigger side lug.
Figure 4:
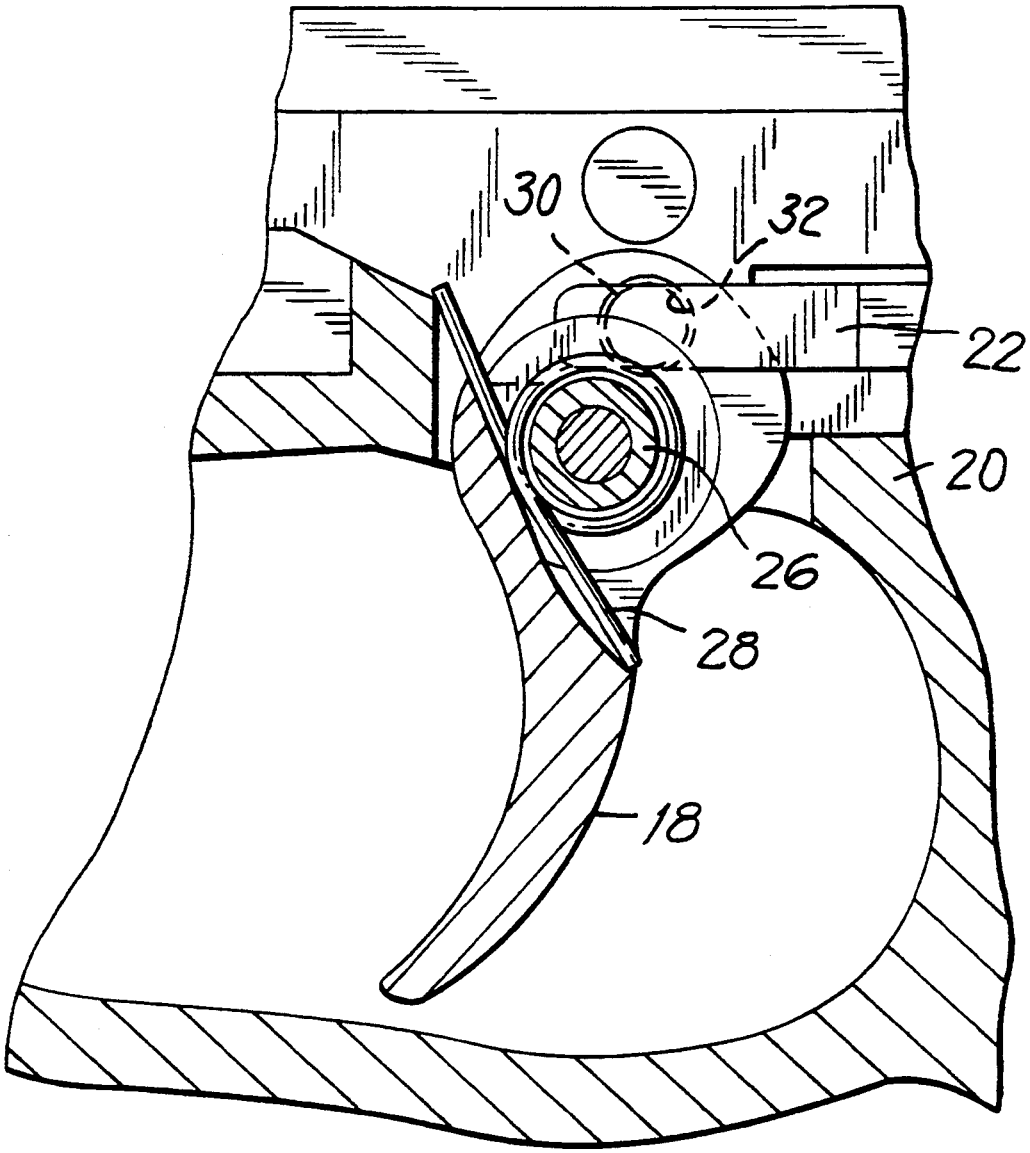
FIG. 4 is a side, sectional view taken along the line 4—4 of FIG. 3 and showing particularly the relationship of the trigger tension spring and the shouldered washer to the trigger and trigger bar.

Referring to the drawings, FIG. 1 shows a typical handgun including the basic elements of handle 12, slide 14, approximate location 16 of the breech of the barrel and trigger 18, all mounted directly or indirectly on frame 20 (FIG. 4). Most pertinent to this invention, trigger bar 22 (FIG. 3) is shown as offset to one side of the gun, which enables the present invention to not only operate with a conventional mechanism, but also with a staggered barrel camming mechanism, which is the subject of contemporaneous developments in handgun design. Trigger bar 22 is attached to only one side lug 24 of trigger 18, rather than being sandwiched between two lugs as is the present state of the art in this field.

Shouldered washer 26 acts as a spacer and boss for trigger tensioning spring 28, while retaining trigger bar 22 in place by means of an abutting relationship.

Figure 2:
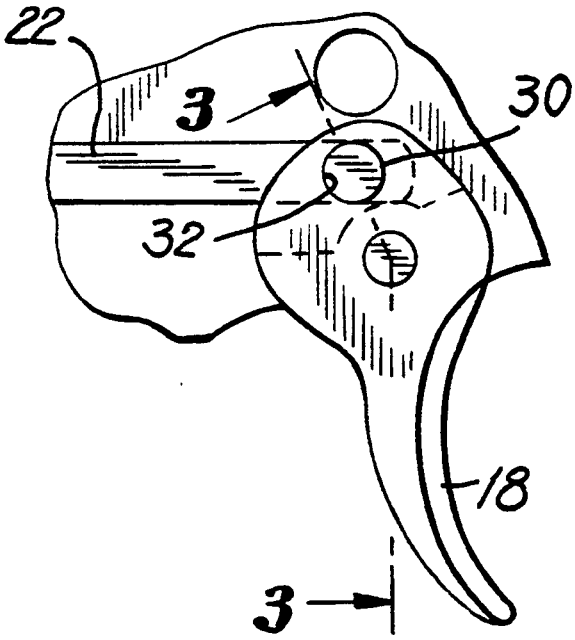
FIG. 2 is a side, sectional view taken along the line 2—2 of FIG. 1 and showing particularly the trigger to trigger bar attachment using a round stud connection.

Trigger bar 22 is attached to trigger 18 by trigger bar stud 30 (FIG. 2), which is a round stud integral with trigger bar 22. Of course, stud 30, alternatively, is part of trigger 18 when trigger bar dimensions permit. Stud 30 fits through a hole 32 defined by trigger side lug 24, thereby allowing trigger bar 22 to swivel, with its rotating center being hole 32. Trigger bar 22 is prevented from working its way out of hole 32 by means of shouldered washer 26 maintaining a close fitting with trigger bar 22. Shouldered washer 26 is installed onto pivot shaft 34 after trigger bar 22 is in place, and has a cut on one side (not shown), so that it fits within the confines of trigger body 18.

By the shouldered washer keeping spring 28 properly positioned and aligned, the weight of trigger pull is changed by varying the thickness of the wire with which spring 28 is formed and varying shoulder thickness for shouldered washer 26.

The foregoing describes preferred and alternative embodiments of the present invention, but is not to be condered as delimiting the invention, which is the function only of the following claims:

What is claimed is:

1. A firearm trigger mechanism for use in a handgun having a handle, a barrel, a firing chamber, a trigger, a trigger bar, a cartridge, a magazine for holding the cartridge and a slide for moving said cartridge from the magazine into the firing chamber comprising a side lug of said trigger for attachment to said trigger bar, a shouldered washer, defining shoulders, for securing said trigger to said trigger bar to retain said trigger bar, a trigger tensioning spring, for which said shouldered washer performs as a spacer and as a boss, a stud for securing said trigger to said trigger bar, said trigger side lug defining a hole therein for allowing the trigger bar to rotate with said hole as a center, a pivot shaft about which said trigger pivots, said shouldered washer being installed onto said pivot shaft, whereby the weight of the pull of said trigger is varied by varying the thickness of said spring, along with varying the thickness of the shoulders defined by said shouldered washer.

2. The invention according to claim 1, wherein said stud is integral with said trigger and said trigger bar defines a stud-receiving hole to accommodate said stud, as a part of said trigger.

3. A firearm trigger mechanism for use in a handgun having a handle, a barrel, a firing chamber, a trigger, a trigger bar, a cartridge, a magazine for holding the cartridge and a slide for moving said cartridge from the magazine into the firing chamber comprising a side lug of said trigger for attachment to said trigger bar, a shouldered washer, defining shoulders, for securing said trigger to said trigger bar to retain said trigger bar, a trigger tensioning spring, for which said shouldered washer performs as a spacer and as a boss, a stud for securing said trigger to said trigger bar, said trigger side lug defining a hole therein for allowing the trigger bar to rotate with said hole as a center, a pivot shaft about which said trigger pivots, said shouldered washer being installed onto said pivot shaft, whereby the weight of the pull of said trigger is varied by varying the thickness of said spring, along with varying the thickness of the shoulders defined by said shouldered washer, wherein said stud is an integral part of said trigger bar and said shouldered washer is close fitting with respect to said trigger bar for preventing removal of said stud from said hole.

* * * * *